United States Patent [19]

Sakai et al.

[11] Patent Number: 4,548,860

[45] Date of Patent: Oct. 22, 1985

[54] ADHESIVE INTERLINING

[75] Inventors: Katsuhide Sakai, Osaka; Noboru Matsui, Moriyama, both of Japan

[73] Assignee: Firma Carl Freudenberg, Weinheim, Fed. Rep. of Germany

[21] Appl. No.: 379,297

[22] Filed: May 18, 1982

[30] Foreign Application Priority Data

May 28, 1981 [JP] Japan ..... 56-82214

[51] Int. Cl.[4] ..... C08F 8/30; B32B 27/00

[52] U.S. Cl. ..... 428/290; 525/183; 525/184; 525/925

[58] Field of Search ..... 525/183, 184, 925; 428/290

[56] References Cited

U.S. PATENT DOCUMENTS

| | | | |
|---|---|---|---|
| 2,982,682 | 5/1961 | Matlin et al. | 525/183 |
| 3,706,613 | 12/1972 | Toki et al. | 264/171 |
| 4,061,619 | 12/1977 | Schaaf et al. | 428/290 |

*Primary Examiner*—John C. Bleutge
*Assistant Examiner*—A. L. Carrillo
*Attorney, Agent, or Firm*—Kenyon & Kenyon

[57] ABSTRACT

An adhesive interlining is described comprising randomly oriented constituent fibers and an adhesive for adhering the interlining to an article of clothing, wherein at least about 40% by weight of the fibers are heat softening fibers having a softening temperature less than the melting temperature of the adhesive, the heat softening fibers having a contraction coefficient of 3.0% or less at their softening temperature.

2 Claims, No Drawings

ADHESIVE INTERLINING

BACKGROUND OF THE INVENTION

The present invention relates to an adhesive interlining used in clothes, and particularly to an adhesive interlining suitable for giving clothes a desirable bulge or silhouette.

For use as an interlining for the front and reverse of clothes such as blazers, suits and the like, it is known to employ both non-adhesive (generally wool) and adhesive interlinings. The former imparts to clothes a desired bulge or silhouette by means of a troublesome sewing technique comprising dart, ease, molding, etc. of flat materials. As a result, clothes obtained by this manner of interlining sewing are expensive, take a considerable amount of time to manufacture, are not of consistent quality, and are apt to lose their shape. On the other hand, clothes obtained by means of adhesive interlining, while not possessing the above disadvantages, are apt to be flat and do not attain the desirable bulge and silhouette.

Japanese Patent Publication No. 25850/1979 discloses a method of giving clothes a desired bulge or silhouette by adhering an adhesive interlining to the right side of cloth by means of an adhesive press using a die which corresponds to the desired bulge or silhouette in respect of shape. As such, the resulting bulge or silhouette is expressed by adhesives applied on an interlining, and an interlining per se (that is to say unwoven fabrics and others) is not constructed in the same shape as the resulting bulge or silhouette. Accordingly, clothes obtained in this manner have a disadvantage of being apt to get out of shape because the interlining itself is apt to return to the original flat shape. In addition, it is difficult to recover the original bulge or silhouette by the usual finishing touches once the clothes get out of shape because it is necessary to again soften and melt the adhesives and to carry out an adhesion in order to recover the original bulge or silhouette.

SUMMARY OF THE INVENTION

It was concluded from the results of an investigation carried out by us aimed at the elimination of the above-described disadvantages incidental to the conventional arts and the provision of the ideal adhesive interlining, that such an ideal adhesive interlining is one that has a function to give the desired bulge or silhouette to clothes, which are fabricated on the flat surface by an adhesive sewing, by means of a finishing press in the final process.

We found from the investigation of various methods for manufacturing an interlining having such a function that such an aim cannot be attained using conventional adhesive interlinings. This conclusion is derived from the fact that the constituent fibers of the conventional adhesive interlining always show a softening temperature higher than the melting point of adhesives (to eliminate adverse effects upon an interlining when an adhesive interlining is adhered onto a right side cloth). Consequently, the action of heat and water or pressure (if necessary) to an interlining to provide the desired bulge or silhouette to an interlining itself makes the adhesive melt so as to give a poor effect upon the adhesion of the interlining to a right side cloth.

According to the present invention, the desired bulge or silhouette can be given by the action of an interlining itself which is constructed in a quite different manner from the conventional adhesive interlining.

In addition, the desired bulge or silhouette can be recovered by the action of heat and water or the like if necessary without having an adverse effect upon adhesives even after clothes have gotten out of shape.

The present invention comprises an adhesive interlining consisting of nonwoven fabrics constructed from constituent fibers, collected at random, on which adhesives are applied, which is characterized by the fact that at least about 40% by weight of said constituent fibers are heat softening fibers showing a softening temperature lower than the melting temperature of said adhesive, said heat softening fibers showing a contraction coefficient of 3.0% or less at their softening temperature.

Nonwoven fabrics constructed from at random collected constituent fibers are used as an interlining itself. This gives the same moldability in all directions to develop an excellent bulge or silhouette. On the contrary, nonwoven fabrics in which constituent fibers are oriented in only one direction, show a different moldability in the direction perpendicular to said orientation direction (as compared to that in the orientation direction) to make it difficult to develop the desired bulge or silhouette. Also, such fabrics shown different moldabilities in the longitudinal direction, lateral direction and bias direction to make it difficult to develop the desired bulge or silhouette.

Various types of known fibers may be used as constituent fibers of nonwoven fabrics. However, it is necessary that at least 40% by weight of the constituent fibers are heat softening fibers showing a softening temperature lower than the melting temperature of adhesives applied on an interlining itself.

The use of heat softening fibers at a ratio lower than 40% by weight is not preferred because the whole interlining cannot be molded into the desired shape even though the heat softening fibers themselves can be molded into the desired shape.

The combinations of said heat softening fibers and adhesives are shown in the following table:

| Heat Softening Fiber (softening temperature) | Adhesives (melting temperature) |
|---|---|
| Acrylonitrile (110° C.) | Polyamide (150° C.) |
| Acrylonitrile (110° C.) | Polyester (150° C.) |
| Non-extended Teflon (90° C.) | Polyamide (150° C.) |
| Polypropylene (130° C.) | Polyamide (150° C.) |
| Vinylidene chloride (130° C.) | Polyamide (150° C.) |
| Polyvinyl chloride (80° C.) | Polyamide (150° C.) |

In particular, polyamide resin is preferably used as the adhesive when the fibrous composition comprises acrylonitrile fibers as said heat softening fibers at the ratio of 40% by weight or more because acrylonitrile fibers have a softening temperature of 110° C. or less under the action of water and heat and an interlining comprising them at the ratio of 40% by weight or more can be molded by means of a finishing press which has been usually used in sewing and laundry.

The "softening temperature" of said heat softening fibers means the temperature at which the heat softening fibers begin to soften under the action of dry heat or wet heat. The "melting temperature" of adhesives means the temperature above which the viscosity of resins is decreased and resins are oozed out onto a right side cloth or oozed out conversely onto an interlining to give an adverse effect upon the adhesion of said right side cloth to said interlining.

It is necessary that the heat softening fibers show a contraction coefficient lower than 3.0% at their softening temperature because otherwise the interlining is remarkably shrunken and the right side cloth develops a bubbling effect when said adhesive interlining is adhered to said right side cloth or clothes are pressed by means of a finishing press. Acrylonitrile fibers are preferably used as the heat softening fibers because they hardly shrink at their softening temperature. Although it goes without saying that other known fibers can be used as said heat softening fibers, it is necessary that their contraction coefficient is adjusted to be 3.0% or less at their softening temperature by controlling the manufacture condition, heat treatment condition and the like. For example, vinylidene chloride fibers must be subjected to a preliminary shrinkage in order to obtain the required 3.0% or less criterion. Although it is difficult to satisfy with a single material both requirements of an exhibition of a function of an adhesive and an exhibition of a function of heat softening fibers (because they have only a slight difference between their softening temperature and their melting temperature) such materials can be used if the temperature is carefully controlled.

Rayon fibers, polyester fibers, polyamide fibers and the like may be used as heat softening fibers of the present invention.

In carrying out the present invention, the right side cloth first is adhered to the interlining on a flat surface (using the adhesive interlining having the construction according to the present invention) without adopting the conventional method in which the interlining is adhered to the right side cloth and simultaneously the adhered assembly is molded. In this case, the interlining is not subjected to stress and the heat softening fibers are not deformed even in their molten state. In addition, the interlining is not deformed because the heat softening fibers show a contraction coefficient of 3.0% or less at their softening temperature. It goes without saying that the interlining must not be adhered to the right side cloth at such a high temperature that the heat softening fibers are so molten as to lose their fibrous form.

The heat softening fibers then are softened (the condition in this time does not give a great influence upon the adhesives) to develop the desired bulge or silhouette by directing steam on clothes fabricated from the adhered assembly (consisting of the interlining and the right side cloth) by means of a finishing press. The resulting clothes are set and cooled with the desired bulge or silhouette to give the desired bulge or silhouette on the interlining itself (that is to say, a nonwoven fabric). This bulge or silhouette is expressed on the clothes. Accordingly, the interlining itself is not apt to return its original form and the clothes using the interlining are not apt to get out of shape.

In addition, the desired bulge or silhouette can be easily recovered by applying the above described procedure by means of a finishing press even when clothes have gotten out of shape. Thus, clothes fabricated from an interlining of the present invention can maintain their beautiful silhouette for a remarkably longer period than clothes fabricated from the conventional adhesive interlining.

What is claimed is:

1. An interlining for imparting a desired bulge or silhouette to clothing, said interlining capable of being first adhesively adhered to said clothing under conditions at which the interlining is not molded to any particular shape and thereafter molded, in contact with said clothing, to a desired shape at conditions which do not affect the adherence of said interlining to said clothing, said interlining comprising randomly collected constituent fibers on which there is applied an adhesive capable of adhering said interlining to said clothing, wherein at least about 40% by weight of said fibers consist of heat softening fibers having a softening temperature lower than the melting temperature of said adhesive, said heat softening fibers having a contraction coefficient of 3.0% or less at their softening temperature.

2. The interlining according to claim 1 wherein said heat softening fibers are acrylonitrile fibers and said adhesive is polyamide resin.

* * * * *